US007896574B2

(12) United States Patent
Nolle et al.

(10) Patent No.: US 7,896,574 B2
(45) Date of Patent: Mar. 1, 2011

(54) SELF-LOCKING MANHOLE COVER

(75) Inventors: Eric R. Nolle, South Wales, NY (US); Jeffrey R. Sullivan, Boston, NY (US)

(73) Assignee: McGard LLC, Orchard Park, NY (US)

( * ) Notice: Subject to any disclaimer, the term of this patent is extended or adjusted under 35 U.S.C. 154(b) by 297 days.

(21) Appl. No.: 12/125,663

(22) Filed: May 22, 2008

(65) Prior Publication Data

US 2009/0255183 A1 Oct. 15, 2009

Related U.S. Application Data

(60) Provisional application No. 61/043,418, filed on Apr. 9, 2008.

(51) Int. Cl.
*E02D 29/14* (2006.01)
*E06B 11/00* (2006.01)

(52) U.S. Cl. ..... 404/25; 52/19

(58) Field of Classification Search ..... 404/25, 404/26; 52/19, 20

See application file for complete search history.

(56) References Cited

U.S. PATENT DOCUMENTS

| | | | |
|---|---|---|---|
| 1,287,290 | A | 12/1918 | Burton |
| 1,400,399 | A | 12/1921 | Yaeche |
| 1,458,391 | A | 6/1923 | Thomas |
| 2,363,567 | A | 11/1944 | Blakeman |
| 3,772,828 | A | 11/1973 | Chahley |
| 3,797,286 | A | 3/1974 | Saporito |
| 3,837,622 | A | 9/1974 | Gale |
| 4,101,154 | A | 7/1978 | Kagstrom |
| 4,577,478 | A | 3/1986 | Economopoulos et al. |
| 4,723,866 | A | 2/1988 | McCauley |
| 4,902,165 | A | 2/1990 | Embree |
| 4,964,755 | A | 10/1990 | Lewis et al. |
| 5,070,564 | A | 12/1991 | Fey |
| 5,082,392 | A | 1/1992 | Marchese et al. |
| 5,328,291 | A | 7/1994 | Wisniewski |

(Continued)

FOREIGN PATENT DOCUMENTS

GB 2257736 A 1/1993

OTHER PUBLICATIONS

"The LockDown System," LockDown-LockDry Division, Barton Southern Company, Inc., Apr. 2005, 1 page.

(Continued)

*Primary Examiner* — Raymond W Addie
(74) *Attorney, Agent, or Firm* — Walter W. Duft

(57) ABSTRACT

A manhole cover having an integrated locking system that is self-locking and easy to open. The device includes a cover plate adapted to rest on a manhole cover support surface of a manhole frame so as to be substantially flush with a top portion of the manhole frame and a surrounding surface in which the manhole frame is situated. An anchor on the cover plate is adapted to engage the manhole frame at a first location in a manner that resists lifting of the cover plate proximate to the first location. A locking member on the cover plate is movable between a locked position and an unlocked position. In the locked position, the locking member is adapted to engage the manhole frame at a second location in a manner that resists lifting of the cover plate proximate to the second location. In the unlocked position, the locking member is disengaged from the manhole frame.

25 Claims, 14 Drawing Sheets

U.S. PATENT DOCUMENTS

| | | | |
|---|---|---|---|
| 5,827,007 | A | 10/1998 | Barton et al. |
| 5,987,824 | A | 11/1999 | Fuller |
| 6,550,294 | B2 | 4/2003 | Garguilo |
| 6,739,796 | B1 | 5/2004 | Del Nero et al. |
| 6,881,007 | B2 | 4/2005 | Dennis |
| 7,201,533 | B2 | 4/2007 | DeGreef |
| 7,201,534 | B2 | 4/2007 | Dennis |
| 7,243,515 | B2 * | 7/2007 | Meyer ..... 70/269 |
| 7,347,070 | B1 | 3/2008 | Spector |

OTHER PUBLICATIONS

"Manhole Protection Underground Infrastructure Security," Manhole Barrier Security Security Systems, Inc., 2006, 4 pages.

* cited by examiner

SELF-LOCKING MANHOLE COVER

CROSS-REFERENCE TO RELATED APPLICATIONS

This application claims the benefit of U.S. Provisional Application Ser. No. 61/043,418, filed on Apr. 9, 2008 and entitled "Self-Locking Manhole Cover." The entire contents of said Application Ser. No. 61/043,418 is incorporated herein by this reference. This application also relates to copending application Ser. No. 11/736,623, filed on Apr. 18, 2007 and entitled "Manhole Access Opening Security Device." This application also relates to copending Application Ser. No. 11/736,634, filed on Apr. 18, 2007 and entitled "Security Key Tool For Manhole Access Opening Security Device". The entire contents of said Application Ser. No. 11/736,623 and said Application Ser. No. 11/736,634 are hereby incorporated herein by this reference.

BACKGROUND OF THE INVENTION

1. Field of the Invention

The present invention relates to lock systems for securing access to manhole openings.

2. Description of the Prior Art

By way of background, standard manhole covers are designed to be easily removed from manhole openings to allow access to underground facilities such as sewers, electrical and communication equipment vaults, and other infrastructure. This presents a security risk by allowing vandals, terrorists and others to gain unauthorized access to important assets, or to move about undetected via underground passageways. Standard manhole covers are also attractive targets for thieves who sell the covers for their scrap metal value.

Various manhole opening locking schemes have been proposed to address such security concerns. One technique is to simply bolt the manhole cover to the underlying manhole frame structure. Although very effective, this method either involves retrofitting existing manhole covers and frames by drilling and tapping bolt holes, or requires that existing covers and frames be replaced with units having preformed bolt holes. Both alternatives are labor intensive and may be prohibitively expensive if the number of manhole locations is large.

Another manhole security technique involves the use of a lockable pan unit situated below a standard manhole cover. The pan unit is used to block the manhole opening, which means that the manhole cover itself does not require locking and does not have to retrofitted or replaced. The pan unit is secured to the manhole frame by resting it on the same support surface that supports the manhole cover (typically a ring flange), and then locking the unit to the manhole frame. A disadvantage of such systems is the requirement for a separate pan that must be separately removed after the manhole cover is removed. Moreover, this solution does not prevent manhole cover theft.

Another manhole security technique involves providing a lock system on the manhole cover itself. A typical lock system includes a pair of retractable lock rods or bars that extend horizontally to engage the side-wall of the manhole frame or the underside of the ring flange or other support surface that supports the manhole cover. A rotatable key is used to rotate a locking apparatus or actuator that actuates the rods or bars into and out of locking engagement. By way of example, U.S. Pat. No. 4,964,755 discloses a manhole cover wherein a lock apparatus is turned by a key to operate a pair of lock rods. However, the lock rods are not self-locking and the key must be used to return the rods to their locked position once the manhole cover is in place. Moreover, the position of the lock rods in the locked position is fixed. Due to dimensional tolerances and differences between manhole frame designs, the lock rods may not firmly engage some manhole frames or may be overly tight in other manhole frames. U.S. Pat. No. 5,082,392 overcomes this problem by spring-biasing a pair of locking bars to their locked position. The locking bars affirmatively engage the manhole frame under the force of the biasing springs. A specially configured portion of a key mates with a vent hole in the manhole cover when the locking bars are in their unlocked position. This allows the locking bars to be held in the unlocked position during opening and closing of the manhole opening. However, the key must remain engaged with the manhole cover at all times when the cover is not covering the manhole, which may be inconvenient.

It is to improvements in manhole opening security systems that the present invention is directed. In particular, what is needed is a security device that improves upon previous designs by reducing the effort required to lock and unlock the device, that provides robust locking capability, and which utilizes an uncomplicated design that is easy to manufacture.

SUMMARY OF THE INVENTION

An advance in the art is obtained by a manhole cover having an integrated locking system that is self-locking and easy to open. The device includes a cover plate adapted to rest on a manhole cover support surface of a manhole frame so as to be substantially flush with a top portion of the manhole frame and a surrounding surface in which the manhole frame is situated. An anchor on the cover plate is adapted to engage the manhole frame at a first location in a manner that resists lifting of the cover plate proximate to the first location. A locking member on the cover plate is movable between a locked position and an unlocked position. In the locked position, the locking member is adapted to engage the manhole frame at a second location in a manner that resists lifting of the cover plate proximate to the second location. In the unlocked position, the locking member is disengaged from the manhole frame.

An example disclosed embodiment illustrates additional optional features. For example, the support surface may comprise an upper surface of an inwardly extending flange on the manhole frame and the anchor may be adapted to engage a lower surface of the flange. The anchor may comprise a rigid bracket. More than one anchor may be provided depending on design requirements. Similarly, more than one locking member may be used. The locking member may comprise a slideable locking pin or the like. A biasing mechanism may be provided on the cover plate to bias the locking member to the locked position. A rotatable locking mechanism may also be provided on the cover plate to engage the locking member. The locking mechanism may have a locking rotational position wherein the locking member is in the locked position and an unlocking rotational position wherein the locking member is in an unlocked position.

BRIEF DESCRIPTION OF THE DRAWINGS

The foregoing and other features and advantages of the invention will be apparent from the following more particular description of example embodiments, as illustrated in the accompanying Drawings, in which.

DETAILED DESCRIPTION OF EXAMPLE EMBODIMENTS

Figure 1:
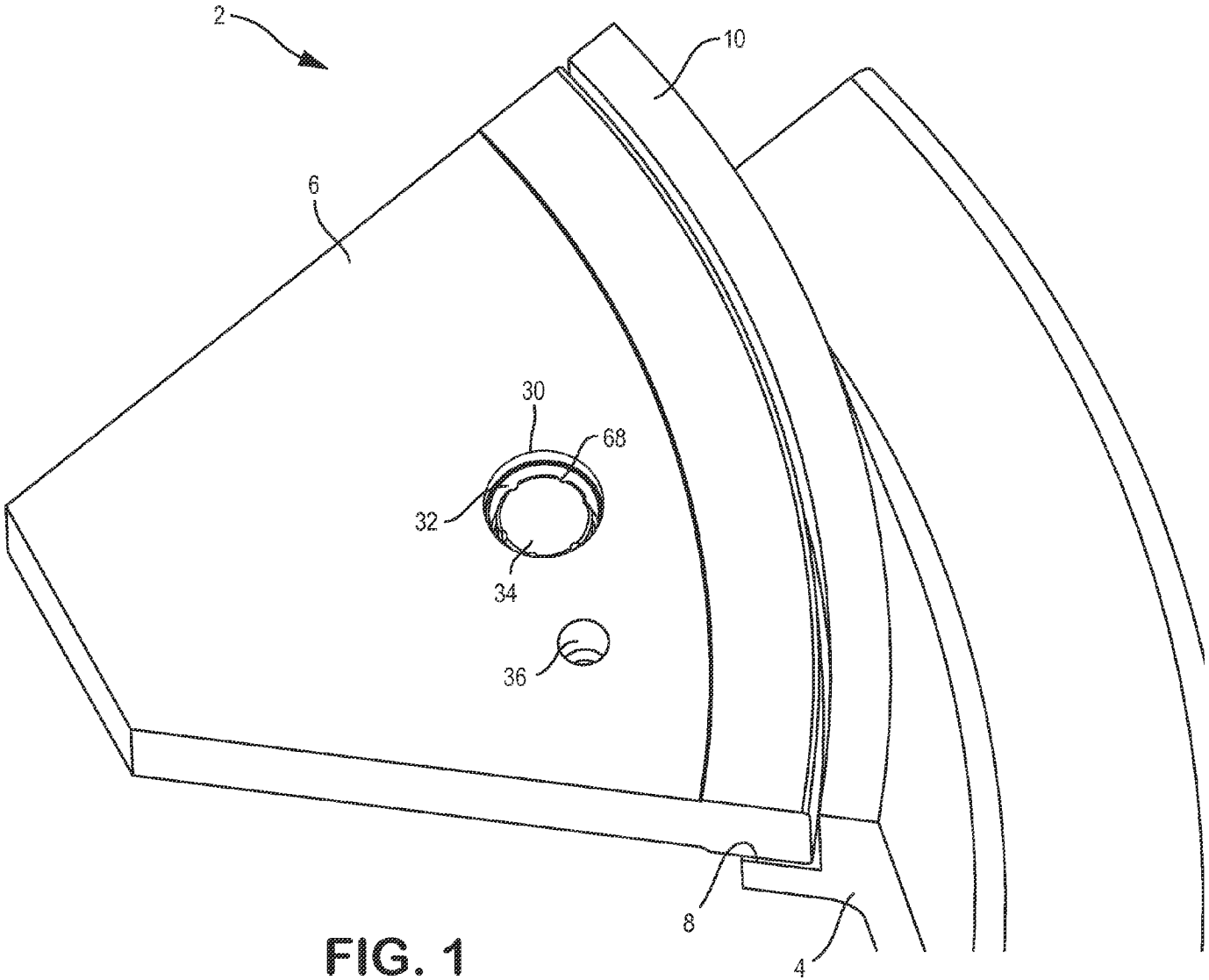
FIG. 1 is a partial perspective view showing a manhole cover having an integrated locking system securing the manhole cover to a manhole frame.

Turning now to FIG. 1, a security manhole 2 includes a manhole frame 4 and a manhole cover plate 6 constructed in accordance with the present disclosure. The cover plate is generally flat and can be made out of any suitable material that is of sufficient strength for the intended application. Examples include, but are not limited to, a durable metal such as steel or a polymer-based composite material. Unless otherwise indicated, the remaining components of the manhole cover (to be described in more detail below) may be formed from stainless steel or any other high strength metal that is resistant to corrosion and other types of environmental degradation. Other materials may also be used, depending on design preferences.

Figure 2:
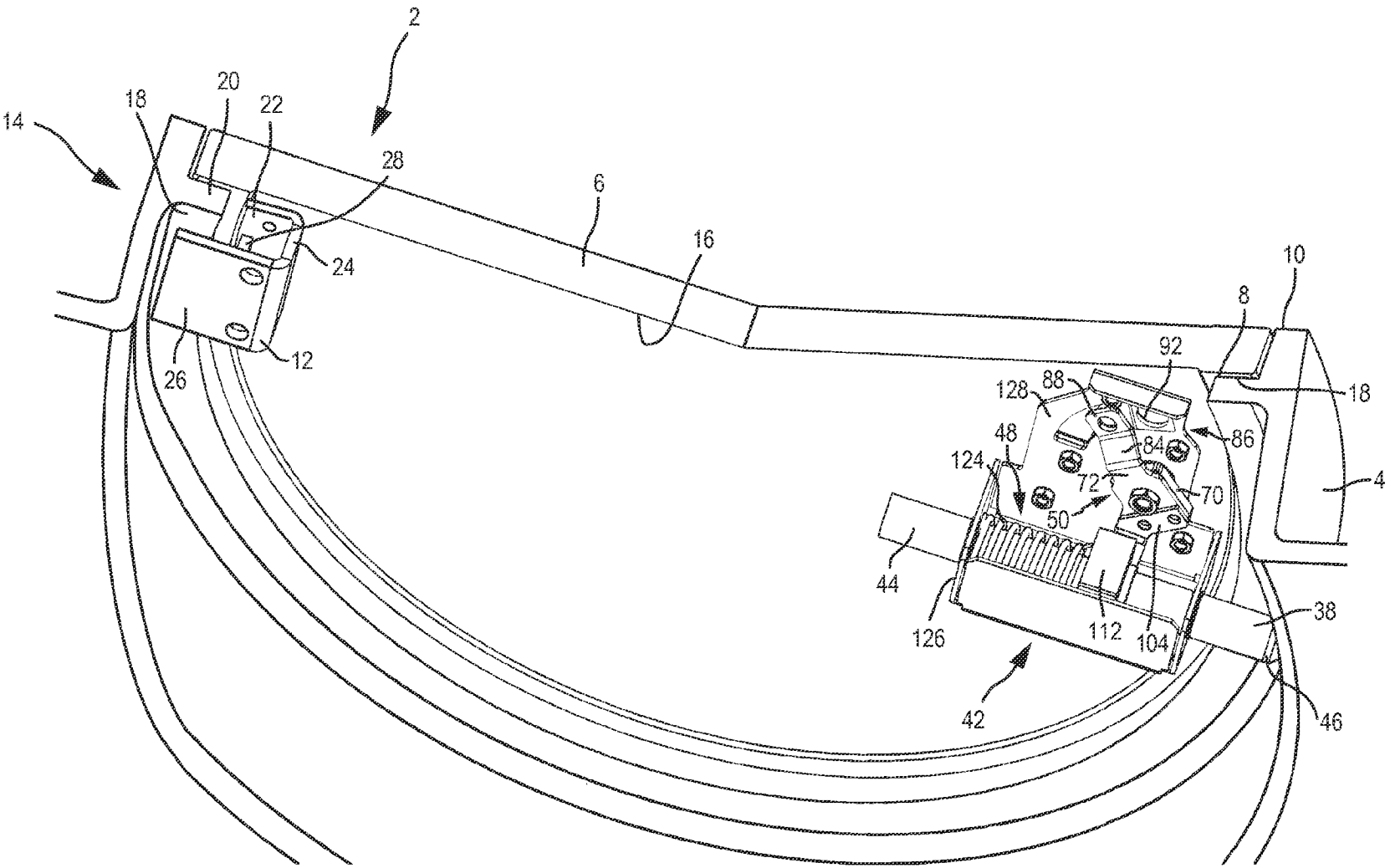
FIG. 2 is a partial perspective view of the underside of the manhole cover of FIG. 1 showing a fixed anchor and locking components.

The cover plate 6 is adapted to rest on a manhole cover support surface 8 (typically a ring flange of the manhole frame 4). In this position, the cover plate 6 is preferably substantially flush with a top portion 10 of the manhole frame and a surrounding surface (not shown) in which the manhole frame is situated (e.g., a roadway, walkway, parking lot, etc.). As shown in FIG. 2, a fixed anchor 12 on the cover plate 6 is adapted to engage the manhole frame 4 at a first location 14 in a manner that resists lifting of the cover plate proximate to the first location. The anchor 12 can be constructed in many ways, including as a rigid bracket that mounts to the underside 16 of the cover plate 6. It will be seen in the example installation of FIG. 2 that the anchor 6 engages a lip 18 on the underside of a flange 20 whose upper surface provides the manhole cover support surface 8. To accommodate this manhole frame configuration, the anchor 12 may be generally U-shaped. In particular, the anchor may have a first leg 22 attached to the cover plate 6, a second leg 24 extending away from the first leg, and a third leg 26 that is spaced from and generally parallel to the first leg. The first leg 22 is long enough to facilitate attachment to the cover plate 6 using bolts, rivets or other suitable fasteners. The second leg 24 is preferably long enough to span the thickness of the flange 20. The third leg 26 is parallel to the lip 18 because the lip orientation is parallel to the surface 8. In some manhole frames, the lip 18 may angle downwardly toward its point of attachment to the remainder of the manhole frame 4 (such that the lip is not sharply defined). In that case, the third leg 26 could be optionally formed so match the lip's downward angle. Alternatively, the parallel third leg configuration of FIG. 2 could be used, with the third leg 26 engaging the lip 18 by point contact on the latter's sloping surface. An optional strut 28 may be provided between the first leg 22 and the third leg 26 to improve the latter's resistance to bending in the event that an attempt is made to remove the cover plate by unauthorized means. The anchor 12 can be made of a durable metal such as steel. The anchor 12 may also be integrally formed as part of the cover plate 6. In an alternative construction, the anchor 12 could be a non-fixed movable structure, such as a slideable anchor pin (see FIGS. 13-14 below). If desired, there can be more than one anchor 12 provided at different locations on the cover plate.

Returning now to FIG. 1, a lock aperture 30 is formed at an off-center location on the cover plate 6. A central location could potentially also be used. Seated in the lock aperture 30 is a lock housing 32 that retains a security lock 34. Using a security key tool (not shown) to engage and rotate the security lock 34, the manhole cover 6 can be unlocked when desired and removed from the manhole frame 4 to allow access to the manhole access opening within. An access hole 36 may also be disposed on the cover plate 6 adjacent to the lock aperture 30. The access hole 36 is provided for releasing a latch (not shown in FIG. 1) that maintains the cover plate 6 in an unlocked position when the cover plate is removed from the manhole frame 4 (as described in more detail below).

Figure 3:
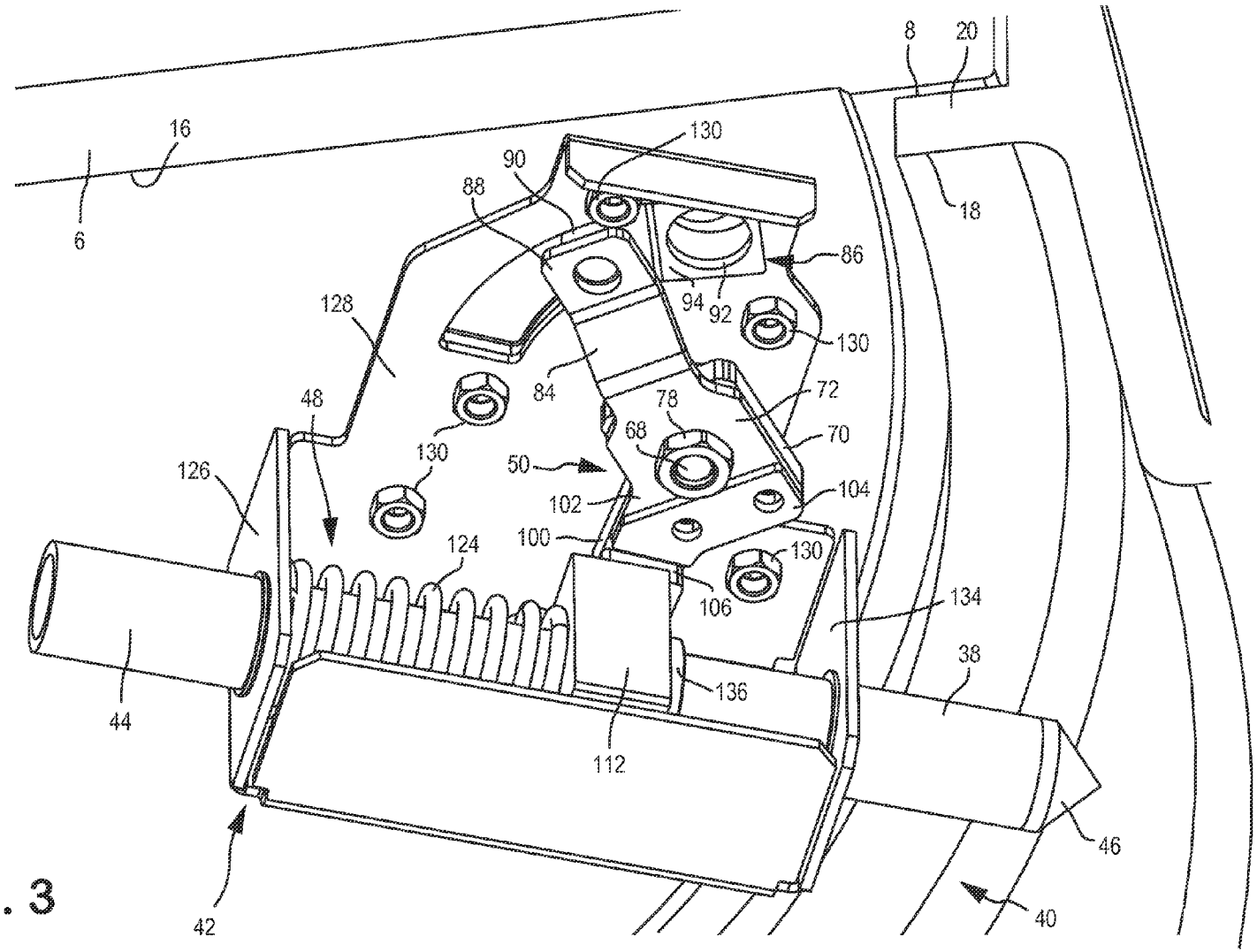
FIG. 3 is an enlarged partial perspective view showing the locking components of FIG. 2 in a locked position.
Figure 4:
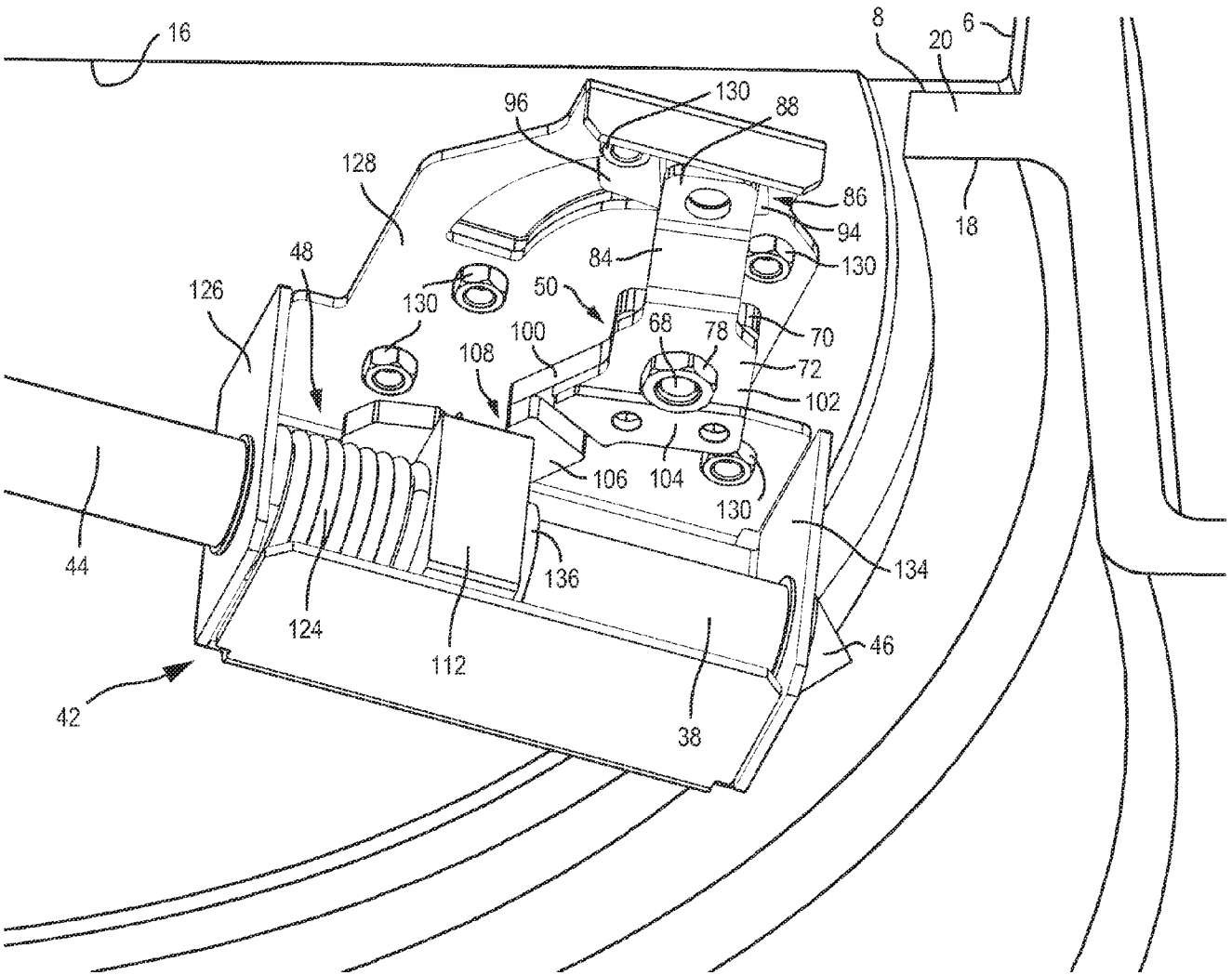
FIG. 4 is an enlarged partial perspective view showing the locking components of FIG. 2 in an unlocked position.

As can be seen in FIGS. 2-4, a locking member 38 on the cover plate 6 is movable between a locked position (FIGS. 2-3) and an unlocked position (FIG. 4). In the locked position, the locking member 38 is adapted to engage the manhole frame 4 at a second location 40 in a manner that resists lifting of the cover plate 6 proximate to the second location. In the unlocked position, the locking member 38 is disengaged from the manhole frame 38. Although not more than one locking member 38 should be required, plural locking members could be provided if desired. The locking member 38 may comprise a locking pin or the like that is slideably mounted to a locking member mount frame 42 (e.g., a sheet metal frame) mounted on the lower side 16 of the cover plate. If formed as a locking pin, the locking member 38 may have a generally tubular lock shaft 44 with a hardened point 46 at one end for engaging the inside wall of the manhole frame 4 below the lip 18. Other types of locking member 38 may also be used in lieu of a locking pin. A biasing mechanism 48 is provided on the cover plate 6 to bias the locking member 38 to the locked position. A rotatable main locking mechanism 50 is also provided on the cover plate 6 to actuate the locking member 38 against the force of the biasing mechanism 48. The locking mechanism 50 has a locking rotational position (FIGS. 2-3) wherein the locking member 38 is in the locked position and an unlocking rotational position (FIG. 4) wherein the locking member is in the unlocked position.

Figure 5:
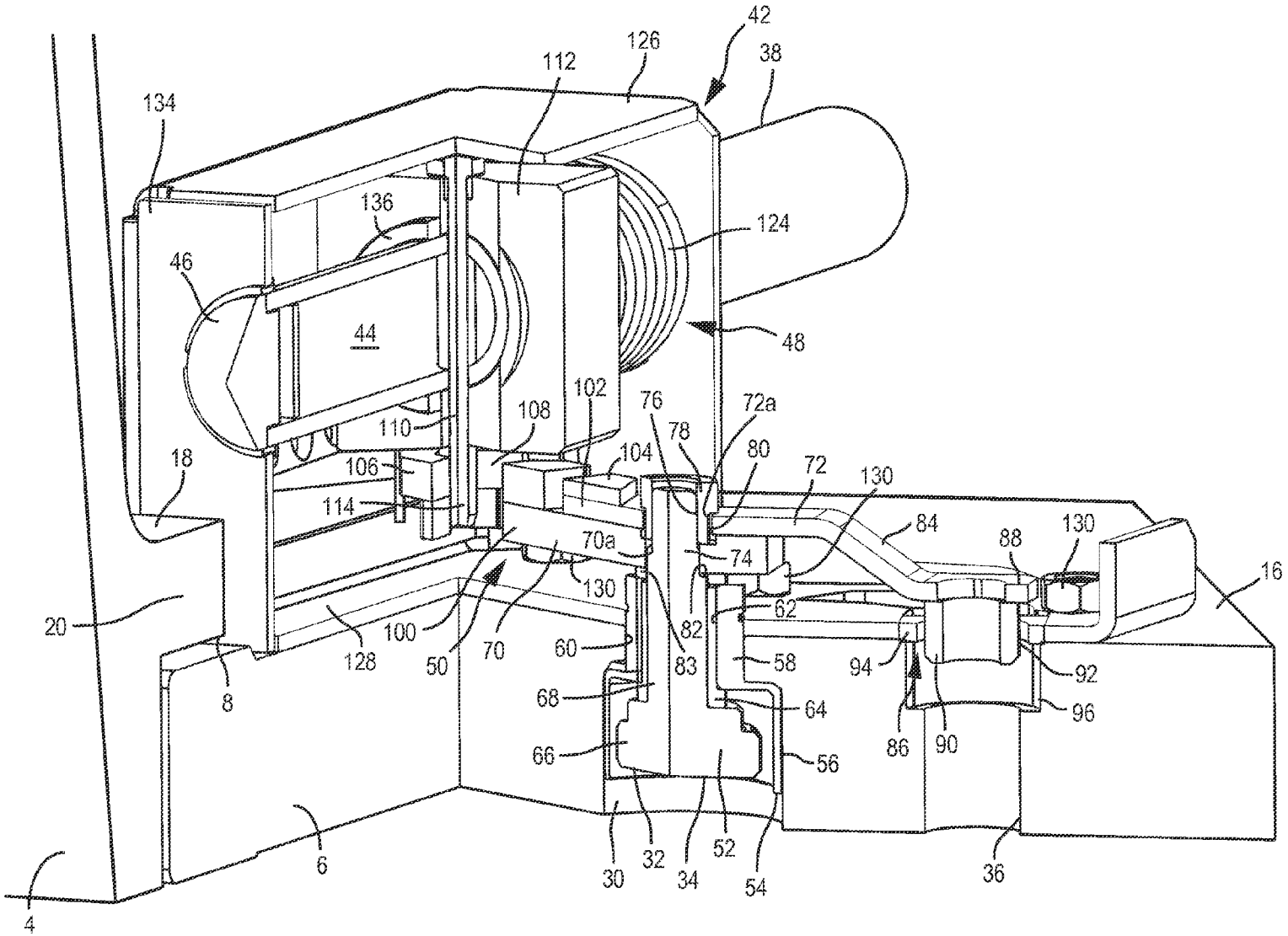
FIG. 5 is an enlarged partially cut-away perspective view showing another view of the locking components of FIG. 2.

Turning now to FIG. 5, the locking mechanism 50 includes a rotatable lock bolt 52 whose exposed face is configured to provide the security lock 34 (FIG. 1). The rotatable lock bolt 52 is received in a fitting 54 that provides the lock housing 32 (FIG. 1). The lock housing fitting 54 is formed with an upper head 56 and a downwardly-extending lower stem 58. The stem 58 of the lock housing fitting 54 is received in a narrowed portion 60 the cover plate's lock aperture 30. The lock housing fitting 54 is also formed with a stepped bore 62 that extends through the head 56 and the stem 58 in order to receive the rotatable lock bolt. A bushing 64 made from brass or the like may be inserted in the bore to facilitate rotation of the rotatable lock bolt 52. The rotatable lock bolt 52 includes an upper head 66 and a downwardly-extending lower stem 68 (note that FIG. 5 shows an upside down view). The top face of the head 66 provides the security lock 34. As shown in FIG. 1, the head 66 may be formed with an undulating curvilinear groove or other security lock pattern 68. The security pattern 68 is configured to receive a mating curvilinear ridge or other security key pattern formed on a security key (not shown).

The stem 68 of the rotatable lock bolt 52 mounts a drive plate 70 and a latch plate 72, both of which have a hub that is formed with a mounting aperture 70*a* and 72*a*, respectively. The drive plate's mounting aperture 70*a* is a key-way that fits onto a key-shaped rotational drive boss 74 (e.g., of non-circular shape) formed on the stem 68 of the rotatable lock bolt 52. The latch plate's mounting aperture 72*a* is round. It receives a short bushing 76 integrally formed on a lock nut 78 that threads onto the end of the rotatable lock bolt stem 68. The lock nut bushing 76 extends through the latch plate's mounting aperture 72*a* and the terminal end of the bushing is received in a counterbore 80 formed at the lower end of the drive plate's key-way aperture 70*a*. During assembly, the lock nut 78 is threaded onto the rotatable lock bolt stem 68 until the lock nut bushing 76 bottoms out in the drive-plate's counterbore 80. The lock nut bushing 76 secures the drive plate 70 in position on a shoulder 82 formed on the rotatable lock bolt stem 68. The head of the lock nut 78 also retains the latch plate 72 on the rotatable lock bolt stem. However, for reasons described in more detail below, the lock nut bushing 76 is long enough so that there will always be a small gap between the latch plate 72 and the lock nut's head. This gap allows the latch plate 72 to flex up and down on the lock nut bushing 76. A washer 83 may be disposed between the drive plate 70 and the bottom of the bushing 64.

With additional reference back to FIGS. 3 and 4, the latch plate 72 includes a latch arm 84 that is adapted to engage a latch 86 provided on the bottom 16 of the cover plate 6. The latch arm 84 extends from the hub of the latch plate 72 and has a small tab 88 at its free end that carries a latch nut 90. The latch nut 90 is adapted to be received in a latch aperture 92 formed in a latch fitting 94 that provides the latch 86. The latch aperture 92 is aligned with the access hole 36 formed in the cover plate 6. A stem portion 96 of the latch fitting defines part of the latch aperture 92. The stem 96 is seated in the access hole 36 from the underside 16 of the cover plate 6. As will be discussed in more detail below in connection with FIG. 6, the latch fitting 94 is also formed with a ramp 98 that the latch nut 90 engages as it approaches the latch aperture 92. The ramp 98 guides the latch nut 90 into the latch aperture 92, flexing the latch arm 72 as it does so.

With continued reference to FIGS. 3-5, the drive plate 70 has a drive arm 100 that extends from the hub of the drive plate 70 to a location that is adjacent to the lock member 38. With its drive arm 100, the drive plate 70 forms a locking member actuator 70/100 that pivots to actuate the locking member 38 when the rotatable lock bolt 52 is rotated. For strength and stiffness, the latch plate 72 is formed with its own drive arm 102 that extends partially along the drive plate drive arm 100. The latch plate drive arm 102 is secured to the drive plate drive arm 100 using appropriate fasteners. If desired, the fasteners may also secure a spacer plate 104 (best shown in FIGS. 3-4) to the opposite side of the latch plate drive arm 102 that does not engage the drive plate drive arm 100. The free end of the drive plate drive arm 100 has a thickened portion 106 that may be integrally formed on the drive plate drive arm or mounted thereto as a separate piece. In the region of the thickened portion 106, the drive plate drive arm 100 is formed with an open slot 108 (FIGS. 4-5) that is adapted to engage a drive pin 110 (FIG. 5) that connects transversely to the locking member 38. The drive pin 110 extends through the drive member's lock shaft 44 and also through a locking spring collar 112 that surrounds the lock shaft 44. The free end 114 of the drive pin 110 that extends beyond the locking spring collar 112 is engaged by the open slot 108 of the drive plate drive arm 100 as it pivots. Pivoting of the drive plate drive arm 100 (representing a component of the locking member actuator 70/100) is thus associated with sliding movement of the locking member 38 through the locking member mount frame 42.

Figure 7:
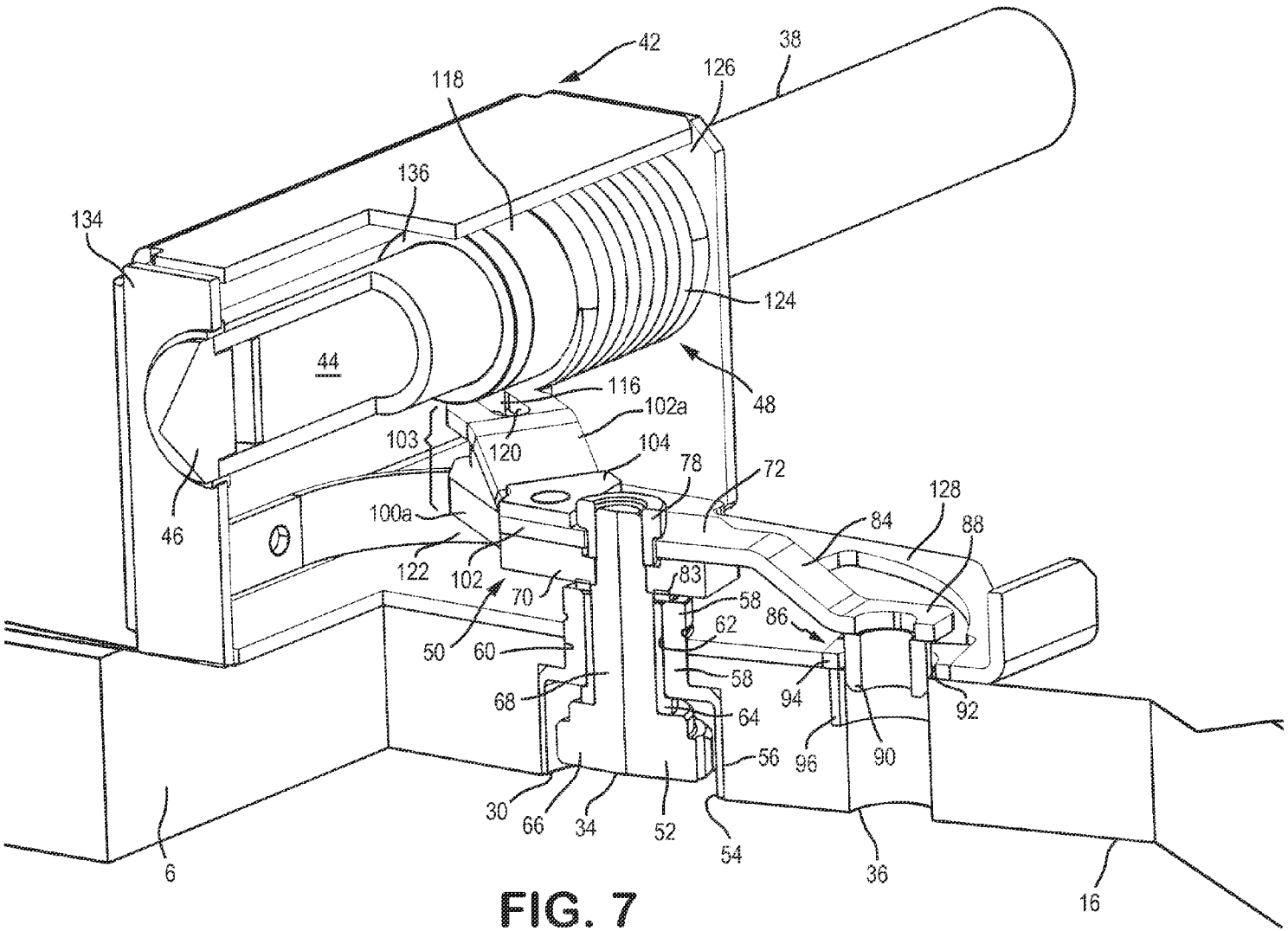
FIG. 7 is an enlarged partially cut-away perspective view showing an alternative embodiment of the locking components of FIG. 2.

In an alternative embodiment shown in FIG. 7, the latch plate drive arm 102 also participates in driving the locking member 38. In particular, the latch plate drive arm 102 includes an extension 102*a* that veers away from a modified drive plate drive arm 100*a* to so that the free ends of the two drive arms are spaced from each other, creating a fork assembly 103. The fork assembly 103 is coupled to a drive pin 116 that connects transversely to the locking member 38. The transverse drive pin connection is provided by a shaft collar 118 that is secured to the locking member's lock shaft 44 (using a set screw or the like). The drive pin 116 extends through slotted holes 120 (only one is shown) in the two drive arms 100*a* and 102*a*. Although not shown, the drive pin 116 may be formed with an annular groove that receives a retainer clip to secure the drive pin to the fork assembly 103. The drive plate drive arm 100*a* is positioned to engage one end of the drive pin 116 and the latch plate drive arm 102*a* is positioned to engage a medial portion of the drive pin. Collectively, the twin drive plate and latch plate drive arms 100*a* and 102*a* provide a locking member actuator 100*a*/102*a* that pivots to actuate the locking member 38 when the rotatable lock bolt 52 is rotated. Due to the fork assembly design of this actuator, normal operational forces imparted by the drive pin 116 will not twist or otherwise deform the two drive arms 100*a* and 102*a*. Pivoting of the twin drive arms 100*a* and 102*a* is associated with sliding movement of the locking member 38 through the locking member mount frame 42. It will also be seen FIG. 7 that a flexible metal tab 122 may be mounted to the locking member mount frame 42 to resiliently engage the drive plate drive arm 100 as it retracts the locking member 38. The metal tab 122 functions as a torque adder that increases the unlocking force required to retract the locking member 38 by resisting the drive plate drive arm 100*a* as it rotates.

As previously mentioned, a biasing mechanism 48 (shown in both embodiments) serves to bias the locking member 38 to its extended locked position. The biasing mechanism 48 can be implemented using a coil spring 124 that is disposed on the locking member 38, which extends axially therethrough. One end of the coil spring 124 bears against the locking spring collar 112 mounted on the locking member's lock shaft 44 (or the shaft collar 118 of the alternative drive arm embodiment of FIG. 7). The other end of each coil spring 124 bears against an end wall 126 of the lock member mount frame 42. The coil spring 124 is in a minimally compressed condition when the locking member 38 is extended to its locked position (FIGS. 2-3). The coil spring 124 becomes more substantially compressed when the locking member 38 is retracted to its unlocked position (FIGS. 4-7). The locking member mount frame 42 may further include a protruding base plate 128 that can be affixed via anchor bolts 130 (or by other means) to the bottom 16 of the cover plate 6.

Figure 6:
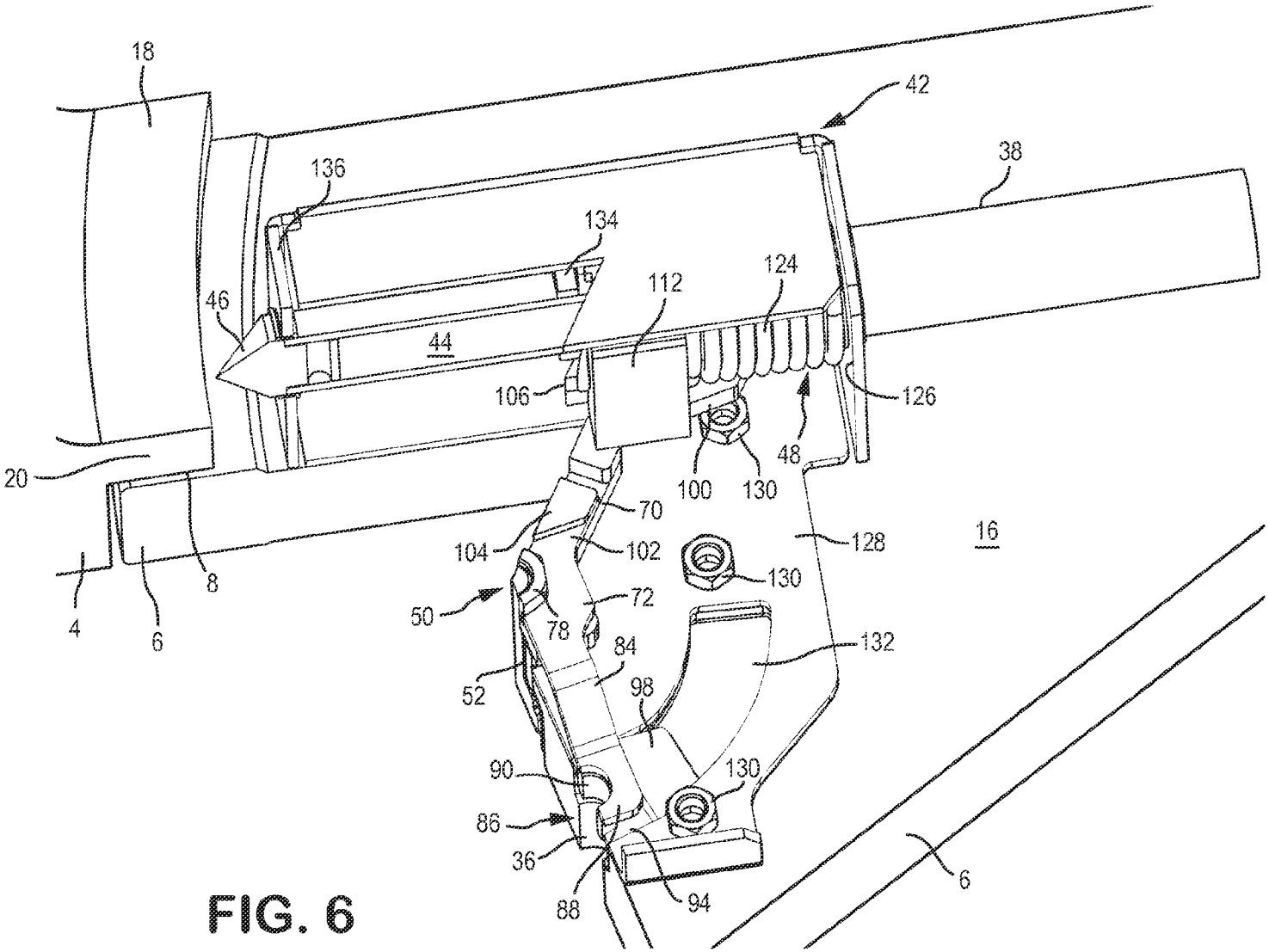
FIG. 6 is an enlarged partially cut-away perspective view showing another view of the locking components of FIG. 2.

When the manhole cover 6 is secured to the manhole frame 4, the locking member 38 is driven by the biasing mechanism 48 to its locked position. This pivots the locking member actuator 70/100 (or 100*a*/102*a* in FIG. 7) due to the coupling provided by the drive pin 110 (or 116 in FIG. 7). The locking mechanism 50 is thereby rotated to its locking position. The latch plate's latch arm 84 will also be operatively driven to an unlatched position. In this position, the latch nut 90 is disengaged from the latch aperture. As can be seen in FIG. 6, an arc-shaped latch recess channel 132 may be formed in the base plate 128 of the locking member mount frame 42 to accommodate the sweep of the latch nut 90 as the latch arm 84 rotates.

When it is desired to disengage the manhole cover 6 from the manhole frame 4, the locking mechanism 50 is rotated. Rotation of the locking mechanism 50 from its locking position is effected by turning a security key (not shown) while it engages the security lock 34 on the head of the rotatable lock bolt 52. The unlocking direction is preferably counterclockwise when looking down on the cover plate. The security key rotates the rotatable lock bolt 52, which in turn pivots the locking member actuator 70/100 (or 100*a*/102*a* in FIG. 7). The drive plate drive arm 100 of the locking member actuator 70/100 (or the fork assembly 103 of the locking member actuator 100*a*/102*a* in FIG. 7) actuates the locking member via the drive pin 110 (or 116 in FIG. 7), causing the locking member 38 to retract against the spring force of the biasing mechanism 48. As the coil spring 124 of the biasing mechanism 48 is deformed, the person operating the security key tool will feel an increasing unlocking force.

Figure 8:
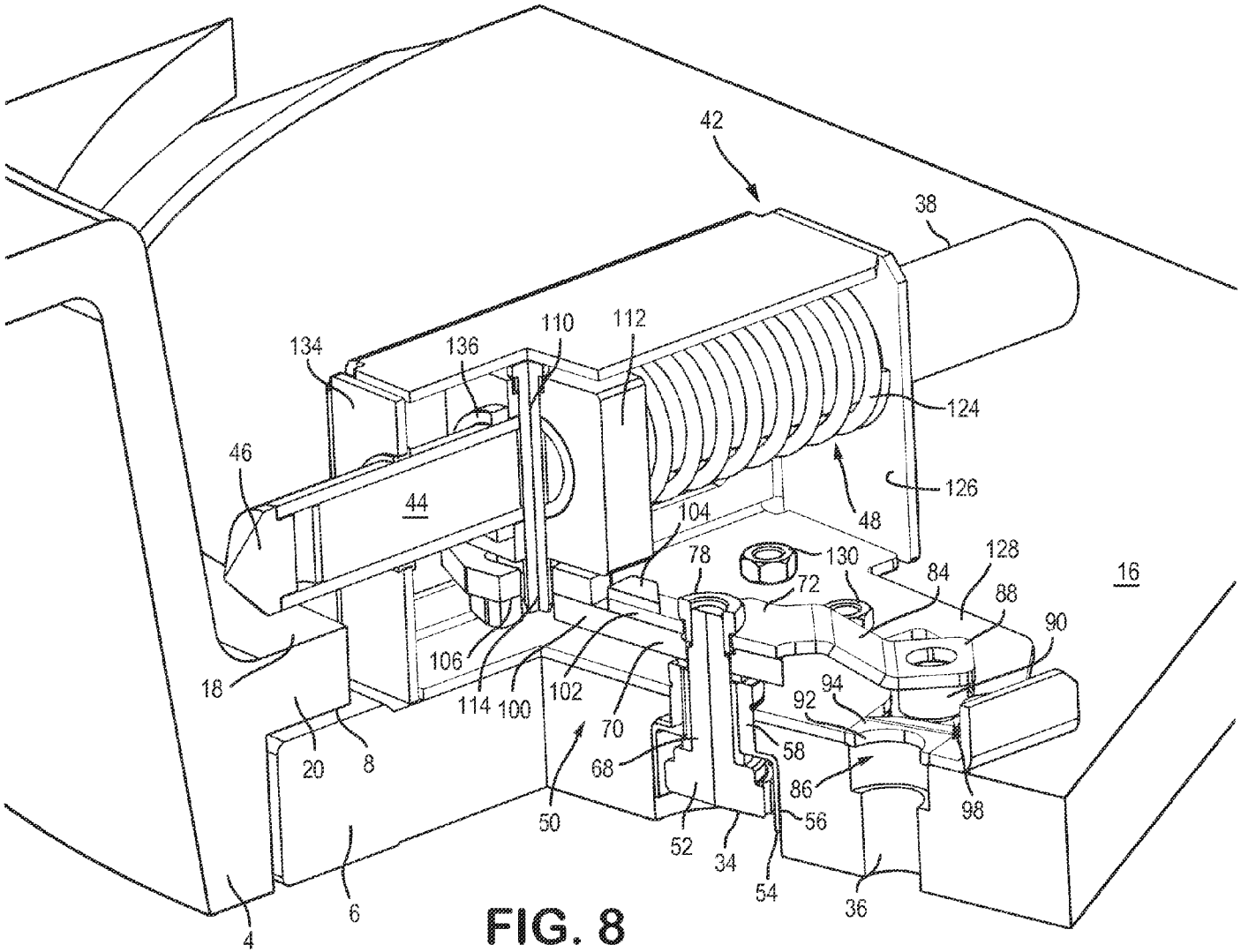
FIG. 8 is an enlarged partially cut-away perspective view showing another view of the locking components of FIG. 2.

Counterclockwise rotation of the locking mechanism 50 also results in the latch arm 84 being pivoted toward the latch 86. As can be seen in FIG. 8, the latch arm 84 and the latch tab 88 are formed such that the latch nut 90 is positioned in a horizontal plane that intersects the surface of the latch ramp 98. As the latch arm 84 pivots, the latch nut 90 moves horizontally toward the ramp 98. When the latch nut 90 engages the ramp 98, the latch arm 84 will bend elastically, causing its fee end portion to displace downwardly as the latch nut 90 rides up the surface of the ramp. This flexes the latch arm 84 and exerts a bending force on the latch plate 72. As described above, there is a slight gap between the hub of the latch plate 72 and the head of the lock nut 78 (FIG. 5). This gap accommodates the latch plate flex displacement and prevents stress risers that could be formed if the lock nut 78 was snugged onto the latch plate 78. Instead, the bending forces on the latch plate 78 are reacted at the spacer plate 104, which is adequately sized to reduce the imparted bending stresses (e.g., it spans the width of the latch plate). As the latch arm 84 continues to rotate, the latch nut 90 eventually clears the ramp 98 and snaps into locking engagement with the latch aperture 92 due to the latch arm returning to its undeformed position. In this configuration, the latch 86 retains the latch arm 84 against counter-rotation, which in turn maintains the locking mechanism 50 in the locking position. This means that the security key can be disengaged from the security lock and the manhole cover 6 can be removed from the manhole frame 4 and placed on the ground or other nearby surface.

The latch 86 is designed with a quick release feature that allows the latch arm 84 to be released once the cover plate 6 is ready to be re-secured to the manhole frame 4. In particular, the access hole 36 (FIG. 1) in the cover plate 6 accommodates a small diameter tool that can be used to contact the latch nut 90 and downwardly deflect the latch arm 84, thereby popping the latch nut 90 out of engagement with the latch aperture 92. Due to the relatively large spring biasing force imparted by the biasing mechanism 48 when the locking mechanism 50 is in the unlocking position, the locking mechanism 50 will snap back to its default locking position as soon as the latch nut 90 clears the latch aperture 92. The locking member 38 will also forcefully spring to its locked position. In order to protect the locking member 38 shaft collar 112 from slamming into the outboard end 134 of the locking member mount frame, a resilient bumper 136 may be mounted on the lock shaft 44 (as can be seen in FIGS. 3-8).

Advantageously, a security key tool as disclosed in copending application Ser. Nos. 11/736,623 and 11/736,634, 116 may be may be used to both unlock and lock the cover plate 6. Rotation of the security lock 34 for approximately one-quarter of a turn (90°) should be sufficient to unlock the cover plate 6 and engage the latch nut 90 in the latch aperture. At this point, the security key can be disengaged from the security lock 34. The tool portion of the disclosed security key tool may be used to lift the cover plate 6 away from manhole frame 4 by virtue of providing the cover plate access opening 36 with threads that can be engaged by the tool. Advantageously, this threaded engagement of the tool cannot result in the latch arm 84 being inadvertently released from the latch. This is because the threaded portion of the tool is not long enough to reach the latch nut 90.

When it is desired to replace the cover plate 6 on the manhole frame, the tool may be used to slide the cover plate into engagement with the manhole frame 4. During this procedure, when the cover plate 6 nearly covers the manhole opening, the anchor 12 will be maneuvered into engagement with the lip 18. Referring back to FIG. 2, this can be accomplished by pulling up on the tool to slightly pivot the cover plate. As can be seen in FIGS. 1 and 2, the access opening 36 that threadably engages the tool is located approximately 180 degrees from the anchor 12. Thus, pulling up on the tool will dip the anchor 12 until the third leg 26 thereof drops below the lip. The cover plate 6 can then be advanced over the remainder of the manhole opening as the third leg 26 slides under the lip 18. The cover plate 6 may then be dropped into fully-seated engagement with the manhole cover support surface 8. The locking mechanism 50 may then be released to secure the lock member 38 to the manhole frame 4.

Figure 9:
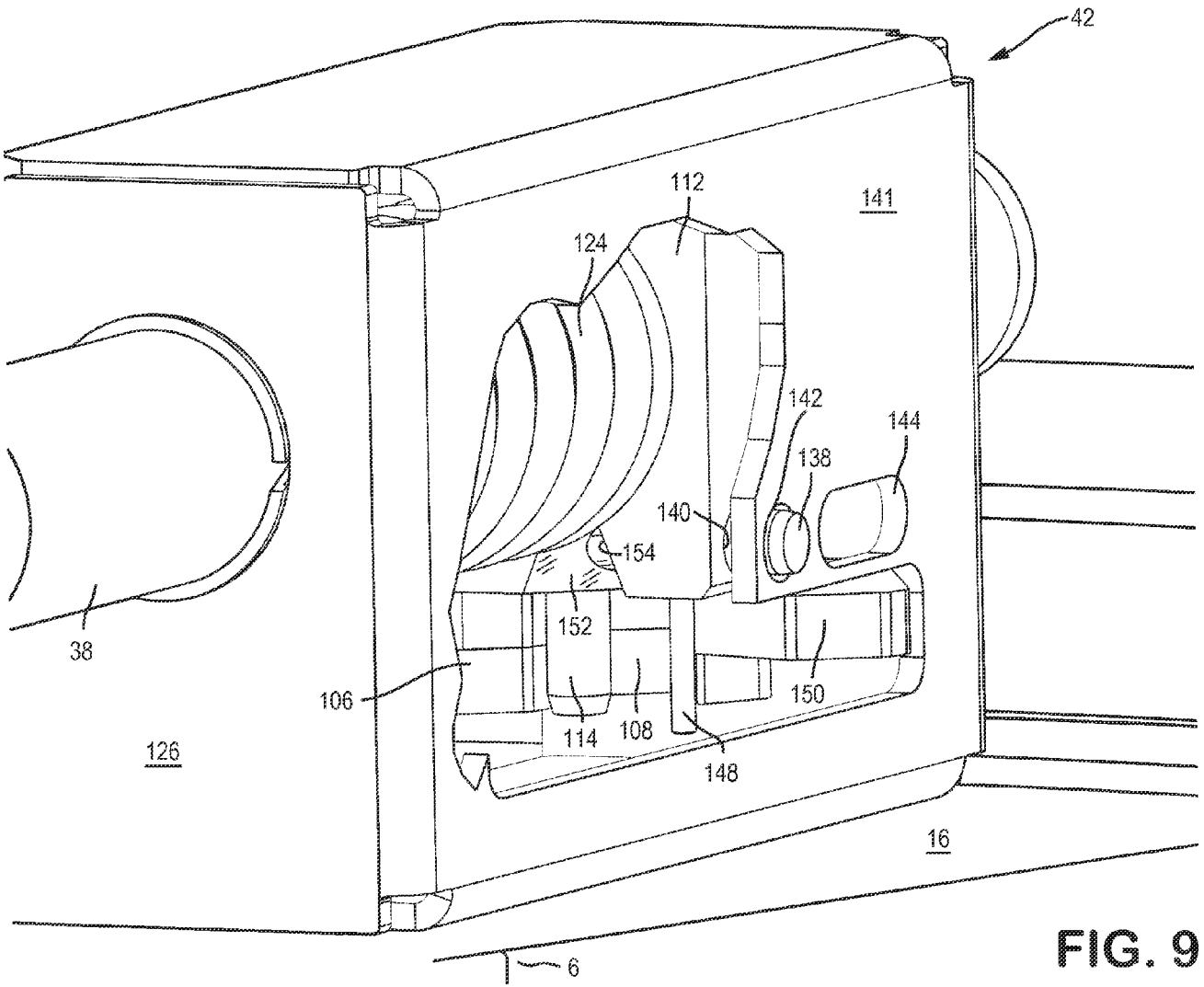
FIG. 9 is an enlarged partially cut-away perspective view showing an anti-retraction device that may be provided as part of the locking components of FIG. 2.
Figure 10:
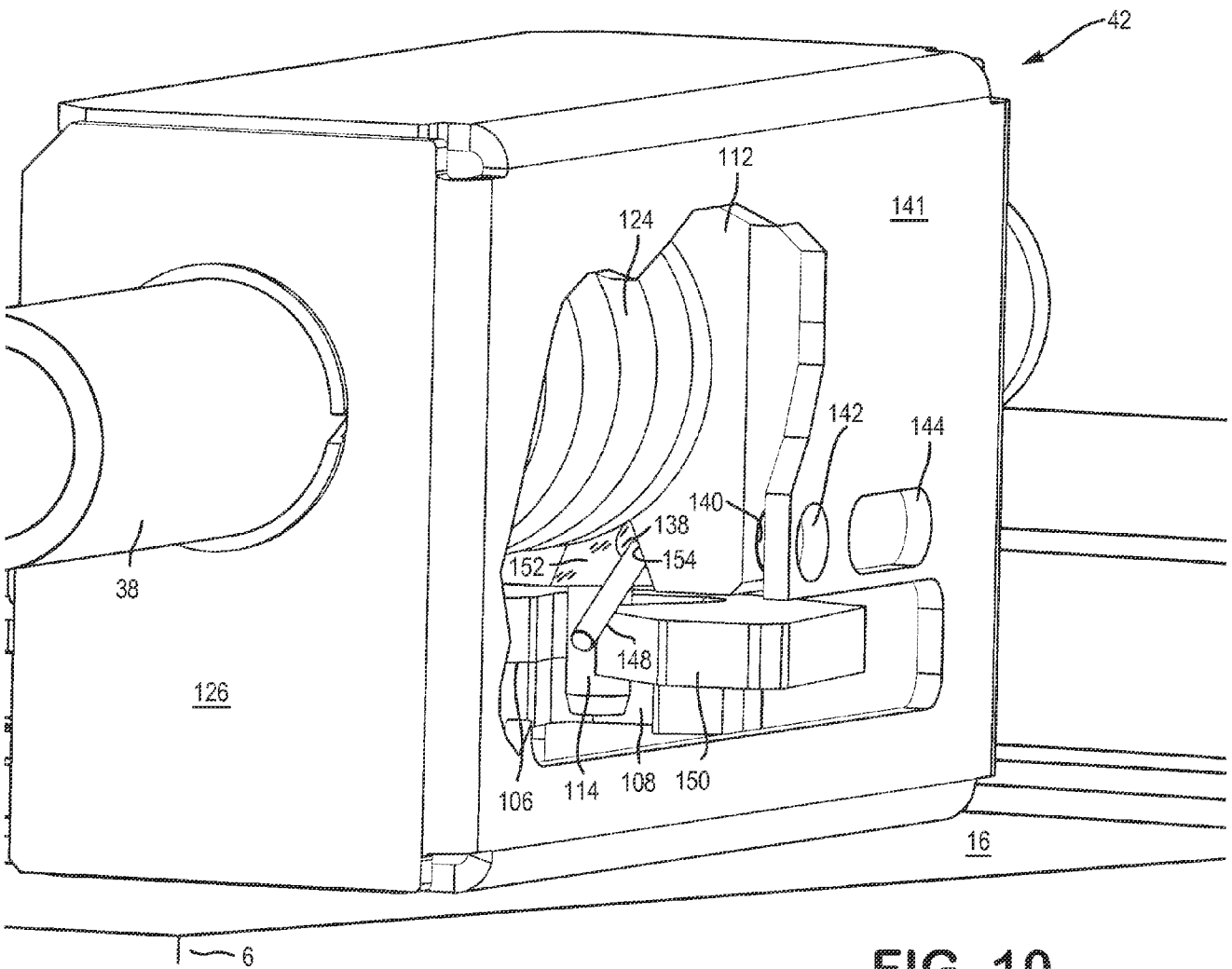
FIG. 10 is an enlarged partially cut-away perspective view showing another view of the anti-retraction device of FIG. 2.

If desired, an optional anti-retraction device may be provided to reduce the likelihood of inadvertent retraction of the locking member 38 due to an attempt to pry the cover plate 6 out of the manhole frame 4 with a pry bar or other unauthorized tool. Turning now to FIGS. 9-10, one way that this feature can be provided is with an anti-retraction security bolt 138 that is slideably mounted in a blind bore 140 formed in the locking spring collar 112 that surrounds the locking member 38. A side wall 141 of the locking member mount frame 42 may then include one or more holes 142 and/or slots 144 that are sized to receive the anti-retraction bolt 138 when the locking member is in various states of extension, including the fully extended position. It will be appreciated that the anti-retraction bolt 138, when so engaged, prevents retraction of the locking member 38. The use of plural holes 142 and/or slots 144 in the locking member mount frame side wall 141 provides redundant security. Thus, if the locking member 38 is able to be retracted past one hole 142 or slot 144, the anti-retraction bolt 138 has an opportunity to engage a subsequent hole or slot and thereby arrest the retraction of the locking member. It may be desirable to have the anti-retraction bolt 138 engage a slot 144 instead of a hole 142 when the locking member 38 is in the fully extended position. This will allow the locking member 38 to retract slightly before the anti-retraction bolt 138 engages the locking member mount frame side wall 141, thereby facilitating self-adjustability of the locking member 38 to accommodate manhole frames of different configuration.

Figure 11:
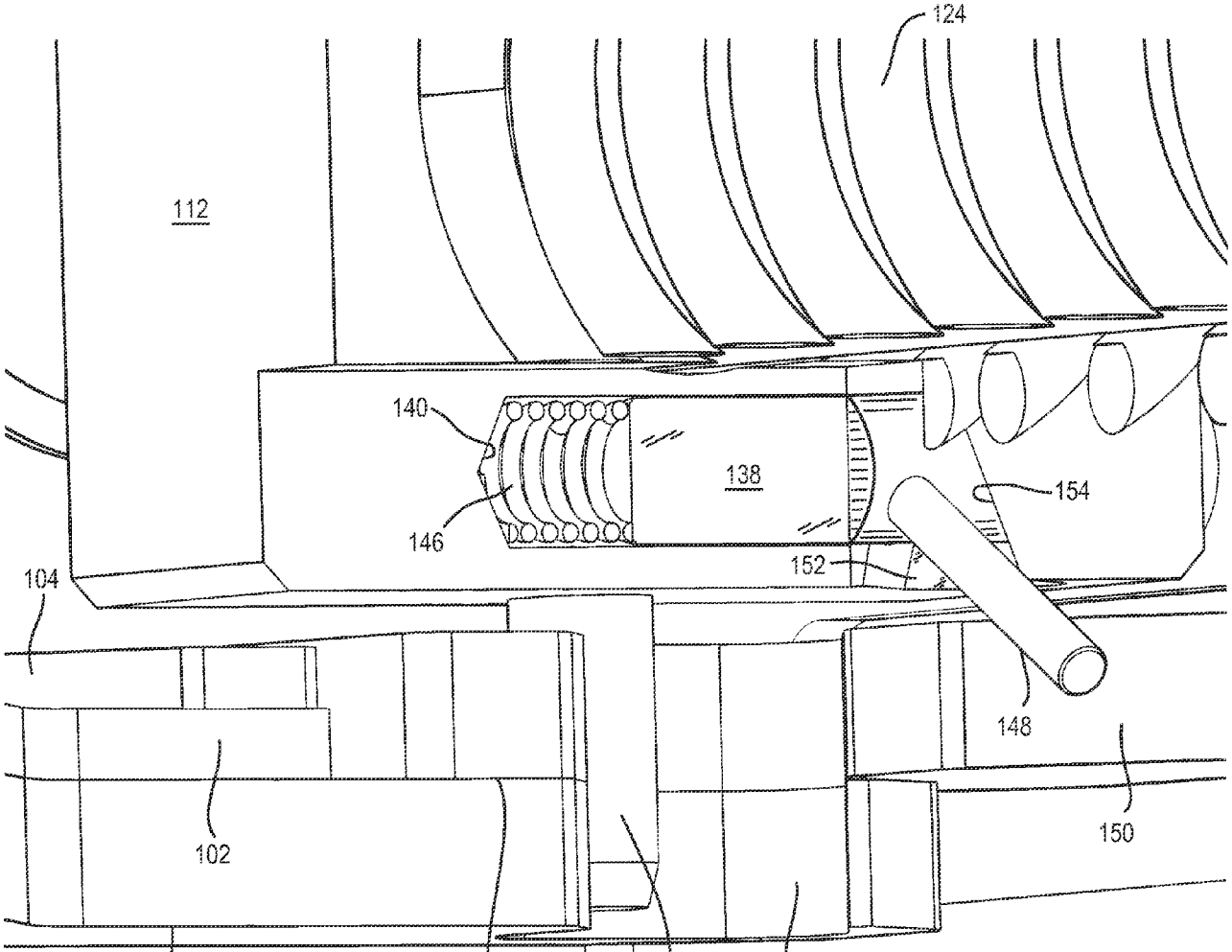
FIG. 11 is an enlarged partially cut-away perspective view showing another view of the anti-retraction device of FIG. 2.
Figure 12:
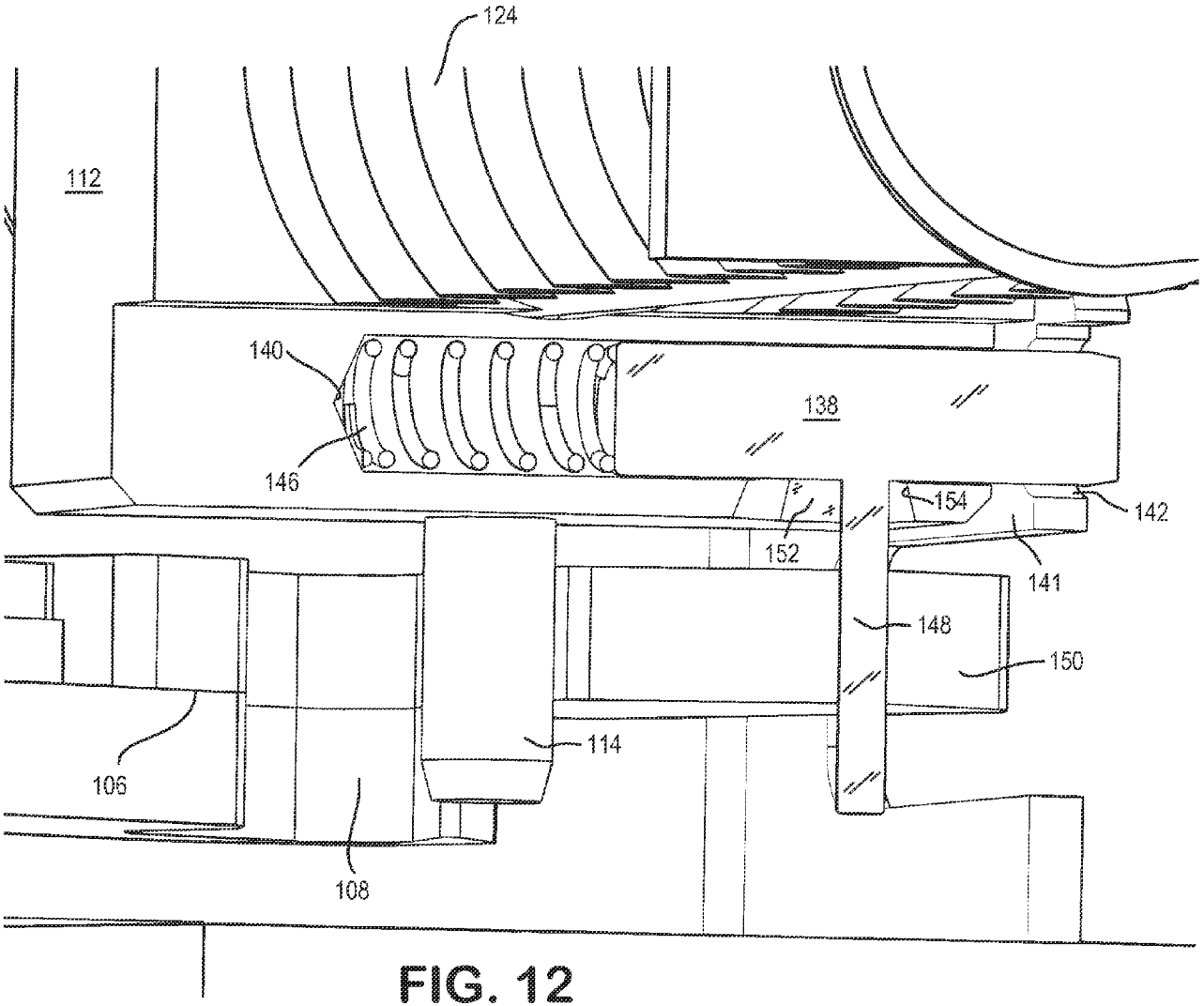
FIG. 12 is an enlarged partially cut-away perspective view showing another view of the anti-retraction device of FIG. 2.

As shown in FIGS. 11-12, the anti-retraction bolt 138 can be biased toward engagement with the locking member mount frame 42 by a small coil spring 146 located at the base of the blind bore 140 in which the anti-retraction bolt 138 is seated. The anti-retraction bolt 138 can be withdrawn from engagement with the locking member mount frame side wall 141 when the locking member actuator 70/100 (or 100*a*/102*a* in FIG. 7) is pivoted. In particular, as can be seen in each of FIGS. 9-12, the anti-retraction bolt 138 may include a peg 148 that is engaged by a cam portion 150 of the drive plate drive arm 100 as the latter pivots. The cam portion 150 forms one side of the slot 108 that engages the drive pin free end 114. As can also be seen in FIGS. 9 and 10, the peg 148 extends transversely from the anti-retraction bolt 138 through a slot 152 in the locking spring collar 112. The slot 152 is open to the blind bore 140 and thus forms a transverse passage therefrom. The slot 152 is angled when its open end is viewed in plan view orientation (looking down on the locking spring collar 112 from the underside 16 of the cover plate 6) to provide a camming surface 154 for the peg 148. As the cam portion 150 of the drive plate drive arm 100 engages the peg 148, the latter swivels into contact with the camming surface 154 (while rotating the security pin 138). Continued swiveling of the peg 148 by the cam portion 150 of the drive plate drive arm 100 causes the camming surface 154 to force the peg 148 (and the anti-retraction bolt 138) to translate toward the base of the blind bore 140. The anti-retraction bolt 138 is thereby driven to overcome the biasing force of the small coil spring 146, with the result that the anti-retraction bolt 138 withdraws from engagement with the locking member mount frame side wall 141 (FIG. 10). The anti-retraction bolt 138 will remain disengaged from the locking member mount frame side wall 141 for as long as the drive plate drive arm 100 maintains the bolt's peg 148 in a sufficiently pivoted position.

Figure 13:
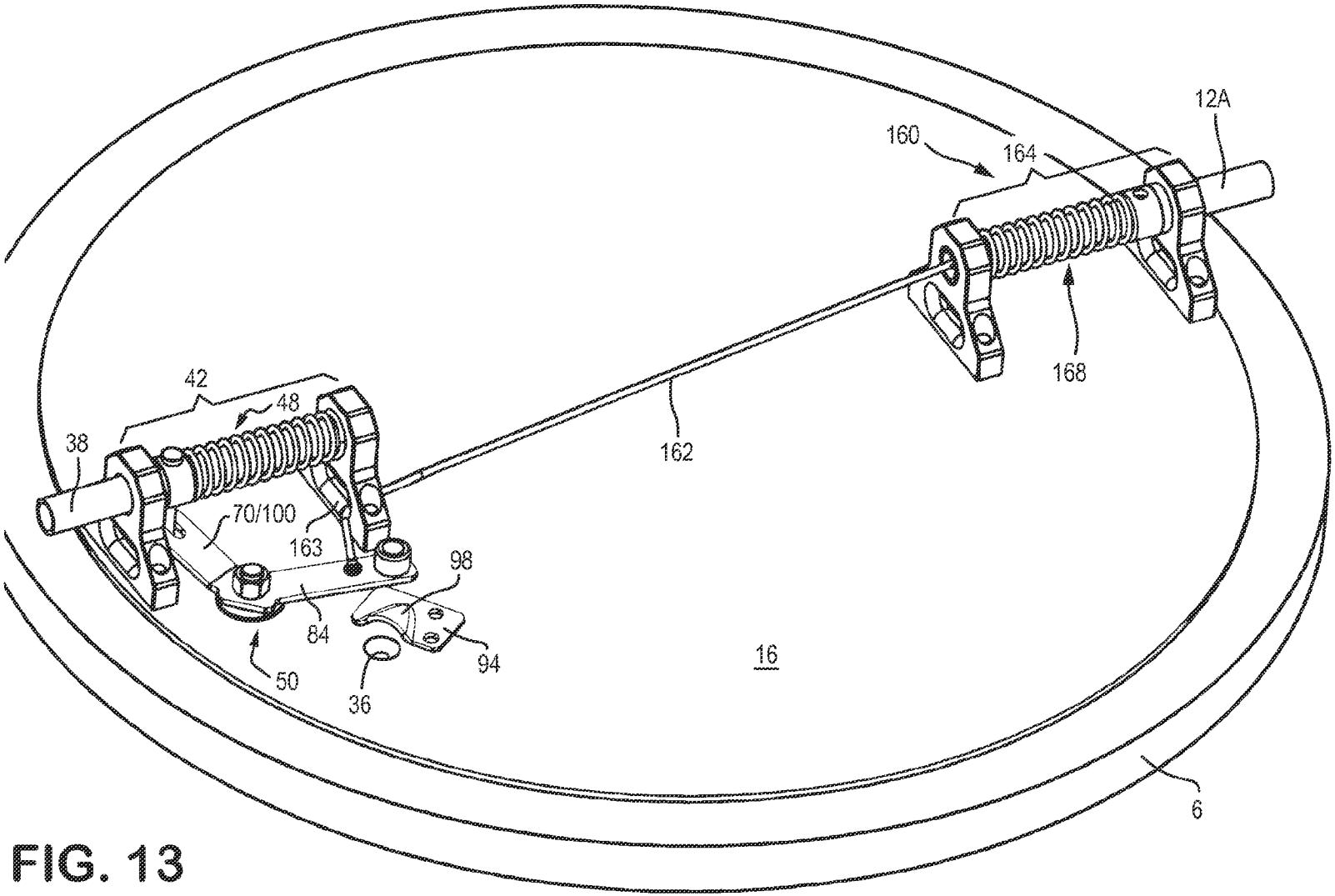
FIG. 13 is a perspective view showing a modification of the manhole cover of FIG. 1 that includes a slideable anchor member in a locked position.
Figure 14:
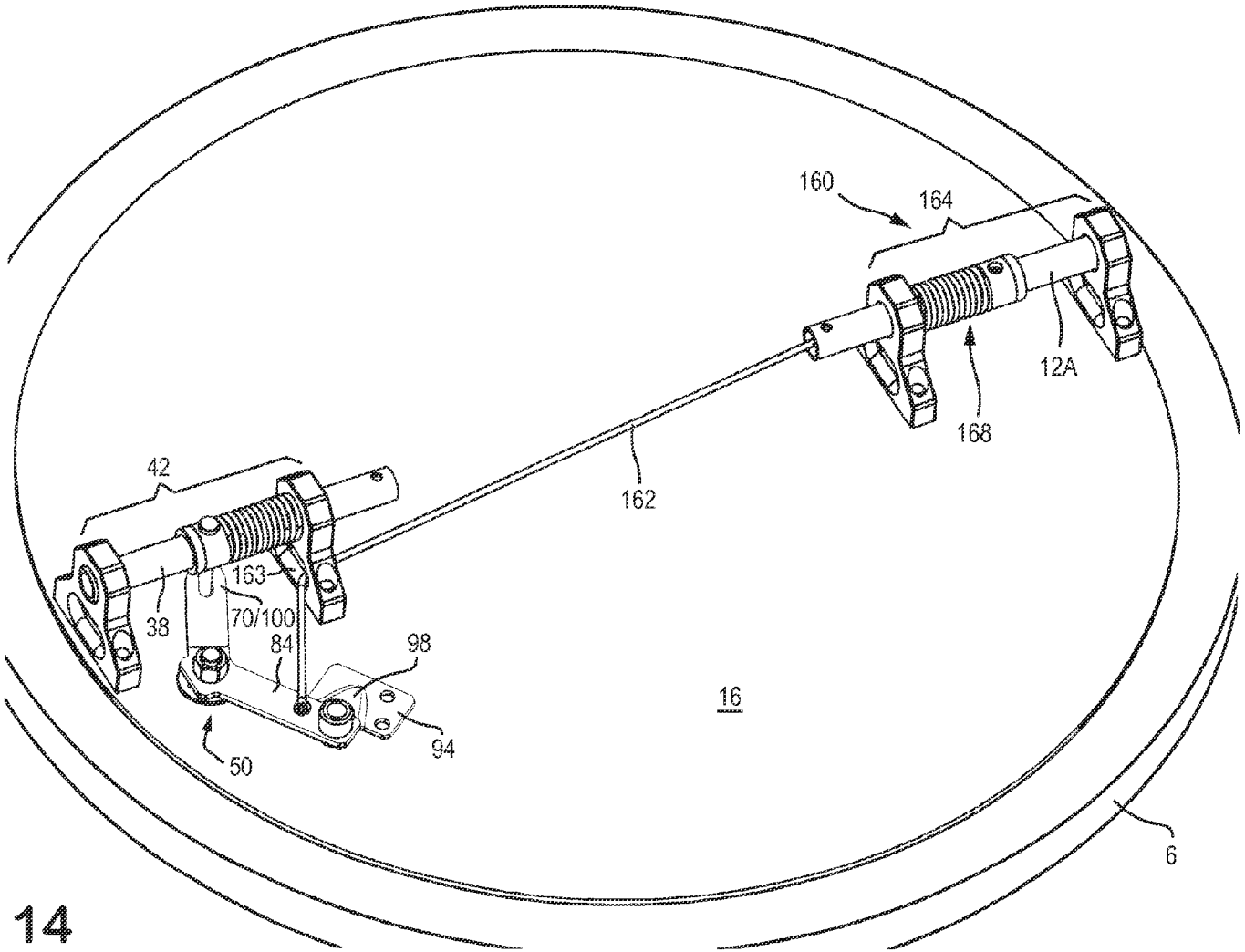
FIG. 14 is a perspective view showing the modified manhole cover of FIG. 13 with the slideable anchor member in an unlocked position.

Turning now to FIGS. 13-14, a modification of the manhole cover plate 6 is shown in which the fixed anchor 12 (FIG. 2) is replaced with a slideable anchor pin 12A. The anchor pin 12A is part of a slave locking mechanism 160 that is operatively connected to the master locking mechanism 50. For example, the anchor pin 12A may be connected by a cable 162 to the latch arm 84. The cable 162 may be routed through a cable guide 163 that can be provided in the mount frame 48 used for the main locking pin 38. As the latch arm 84 is rotated from its unlatched position (FIG. 13) to its latched position (FIG. 14), the cable 162 retracts the anchor pin 12A from a locked position (FIG. 13) to an unlocked position (FIG. 14). The anchor pin 12A can be slideably mounted within its own mount frame 164. An anchor pin biasing mechanism 168 may be used to bias the anchor pin 12A to its locked position. When the latch arm 84 is released from its latched position (FIG. 14) to its unlatched position (FIG. 13), the anchor pin 12A will be driven from its unlocked position (FIG. 14) back to its locked position (FIG. 13). If desired, the mount frame 164 and the biasing mechanism 168 for the anchor pin 12A may be constructed similarly to the mount frame 42 and the biasing mechanism 48 used for the locking pin 38. Note that in FIGS. 13-14, the configuration of the mount frame 42 is somewhat different than its configuration in other figures, thus demonstrating the wide variety of design alternatives that may be implemented in accordance with the disclosure herein without departing from the spirit and scope of the invention as set forth in the claims. Modified configurations for the latch fitting 94 and the latch ramp 98 are also shown in FIGS. 13-14.

Accordingly, a self-locking manhole cover for securing a manhole access opening has been disclosed. While exemplary embodiments have been shown and described, it should be apparent that many variations and alternative embodiments could be implemented in accordance with the teachings herein. For example, the disclosed embodiments feature a latching configuration wherein the locking mechanism 50 is axially fixed relative to the cover plate 6 and the latch arm 84 is deflected out of engagement with the latch 86. In an alternative embodiment, the latch arm 84 could be disengaged from the latch 86 without having to deflect if the entire locking mechanism 50 was downwardly positionable relative to the cover plate 6. In that case, the locking mechanism 50 could be urged downwardly (e.g., against a biasing force) in order to disengage the latch arm 84 from the latch 86. It is understood, therefore, that the invention is not to be in any way limited except in accordance with the spirit of the appended claims and their equivalents.

What is claimed is:

1. A self-locking manhole cover, comprising:

a cover plate adapted to rest on a manhole cover support surface of a manhole frame so as to be substantially flush with a top portion of said manhole frame and a surrounding surface in which said manhole frame is situated;

an anchor on said cover plate adapted to engage said manhole frame at a first location in a manner that resists lifting of said cover plate proximate to said first location;

a locking member on said cover plate that is movable between a locked position in which said locking member is adapted to engage said manhole frame at a second location in a manner that resists lifting of said cover plate proximate to said second location, and an unlocked position in which said locking member is not adapted to engage said manhole frame;

said locking member being biased by a biasing force toward said locked position;

a locking mechanism adapted to drive said locking member to said unlocked position in response to actuation by a security key on an upper side of said cover plate; and said locking mechanism being further operable, without said security key, to maintain said locking member in said unlocked position against said biasing force when said cover plate is removed from said manhole frame, and being actuatable from said upper side of said cover plate to release said locking member from said locking position after said cover plate has been returned to said manhole.

2. A manhole cover in accordance with claim 1, wherein said support surface comprises an upper surface of an inwardly extending flange on said manhole frame and said anchor is adapted to engage a lower surface of said flange.

3. A manhole cover in accordance with claim 1, wherein said anchor comprises a rigid bracket.

4. A manhole cover in accordance with claim 1, wherein said anchor comprises a movable anchor member operatively connected to be movable in concert with said locking member between a locked position in which said movable anchor member is adapted to engage said manhole frame, and an unlocked position in which said movable anchor member is not adapted to engage said manhole frame.

5. A manhole cover in accordance with claim 1, wherein there is only one of said anchor member and said locking member.

6. A manhole cover in accordance with claim 1, wherein said locking member comprises a slideable locking pin.

7. A manhole cover in accordance with claim 1, wherein said locking member is biased by a biasing mechanism on said cover plate adapted to bias said locking member to said locked position.

8. A manhole cover in accordance with claim 1, wherein said locking mechanism comprises a rotatable locking mechanism on said cover plate engaging said locking member and having a locking rotational position wherein said locking member is in said locked position and an unlocking rotational position wherein said locking member is in said unlocked position.

9. A manhole cover in accordance with claim 8, wherein said locking mechanism comprises a security lock adapted to receive a security key that applies a rotational torque to said locking mechanism.

10. A manhole cover in accordance with claim 9, further including a latch on said cover plate adapted to releasably retain said locking mechanism in said unlocking rotational position without said security lock being engaged by a security key.

11. A self-locking manhole cover, comprising:

a cover plate adapted to rest on a manhole cover support surface of a manhole frame so as to be substantially flush with a top portion of said manhole frame and a surrounding surface in which said manhole frame is situated;

an anchor on said cover plate adapted to engage said manhole frame at a first location in a manner that resists lifting of said cover plate proximate to said first location;

a locking member on said cover plate that is movable between a locked position in which said locking member is adapted to engage said manhole frame at a second location in a manner that resists lifting of said cover plate proximate to said second location, and an unlocked position in which said locking member is not adapted to engage said manhole frame;

a biasing mechanism on said cover plate adapted to bias said locking member to said locked position;

a rotatable locking mechanism on said cover plate engaging said locking member and having a locking rotational position wherein said locking member is in said locked position and an unlocking rotational position wherein said locking member is in said unlocked position;

said locking mechanism having a security lock adapted to receive a security key that applies a rotational torque to said locking mechanism; and a latch on said cover plate adapted to releasably retain said locking mechanism in said unlocking rotational position without said security lock being engaged by a security key.

12. A manhole cover in accordance with claim 11, wherein anchor is fixed.

13. A manhole cover in accordance with claim 12, wherein said anchor comprises a bracket that is adapted to engage a lip on said manhole frame that is below said manhole cover support surface.

14. A manhole cover in accordance with claim 11, wherein said anchor comprises a movable anchor member operatively connected to be movable in concert with said locking member between a locked position in which said movable anchor member is adapted to engage said manhole frame, and an unlocked position in which said movable anchor member is not adapted to engage said manhole frame.

15. A manhole cover in accordance with claim 11, wherein said locking member is slideably mounted to a locking member mount on said barrier.

16. A manhole cover in accordance with claim 15, further including an anti-retraction device that prevents inadvertent refraction of said locking member from said locked position.

17. A manhole cover in accordance with claim 11, wherein said locking mechanism comprises a locking member actuator coupled to said locking member.

18. A manhole cover in accordance with claim 11, wherein said locking mechanism comprises a latch arm adapted to engage said latch.

19. A manhole cover in accordance with claim 11, wherein said latch comprises a latch aperture and a ramp on one side of said aperture for guiding a latch arm portion of said locking mechanism into said aperture as said locking mechanism is rotated from said locking rotational position to said unlocking rotational position.

20. A manhole cover in accordance with claim 19, wherein said cover plate comprises an aperture aligned with said latch aperture to receive a tool adapted to displace said latch arm out of said recess so that said biasing member may return said locking member to said locked position.

21. A self-locking manhole cover, comprising:

a cover plate adapted to rest on a manhole cover support surface of a manhole frame so as to be substantially flush with a top portion of said manhole frame and a surrounding surface in which said manhole frame is situated;

an anchor member on said cover plate adapted to engage said manhole frame at a first location in a manner that resists lifting of said cover plate proximate to said first location;

a locking pin on said cover plate that is movable between a locked position in which said locking pin is adapted to engage said manhole frame at a second location in a manner that resists lifting of said cover plate proximate to said second location, and an unlocked position in which said locking pin is not adapted to engage said manhole frame;

a spring mechanism adapted to bias said locking pin to said extended position;

an off-center aperture in said cover plate;

a fitting in said cover plate aperture having a rotatable lock bolt;

a locking pin actuator operatively driven by said rotatable lock bolt, said locking pin actuator engaging said locking pin and having a locking rotational position wherein said locking pin is in said extended position and an unlocking rotational position wherein said locking pin is in said retracted position;

said rotatable lock bolt comprising a security lock disposed in said cover plate aperture and adapted to receive a security key tool that applies a rotational torque to said locking pin actuator;

a latch arm operatively driven by said rotatable lock bolt; and a latch on said cover plate adapted to releasably retain said latch arm in said unlocking rotational position without said security lock being engaged by said security key tool.

22. A manhole cover in accordance with claim 21, further including an anti-retraction device that prevents inadvertent refraction of said locking pin from said locked position.

23. A manhole cover in accordance with claim 21, wherein said anti-retraction device is adapted to redundantly secure said locking pin against retraction from said locked position.

24. A manhole cover in accordance with claim 21, wherein said latch comprises a latch aperture and a ramp on one side of said aperture for guiding a latch-engaging portion of said latch arm into said aperture as said rotatable lock bolt is rotated to rotate said locking pin actuator from said locking rotational position to said unlocking rotational position.

25. A manhole cover in accordance with claim 24, wherein said cover plate comprises an aperture aligned with said latch aperture to receive said second portion of said security key tool, said second portion being adapted to displace said latch-engaging portion of said latch arm out of said latch aperture so that said spring member may return said locking pin to said extended position.

* * * * *